United States Patent [19]

Taylor

[11] 3,971,234

[45] July 27, 1976

[54] DOUBLE-KNIT ELASTIC FABRIC WITH RAISED PATTERNS

[75] Inventor: Harold J. Taylor, Wilmington, Del.

[73] Assignee: E. I. Du Pont de Nemours and Company, Wilmington, Del.

[22] Filed: Sept. 4, 1974

[21] Appl. No.: 503,180

[52] U.S. Cl. ..... 66/200; 66/196; 66/172 E

[51] Int. Cl.[2] ..... D04B 9/06

[58] Field of Search ..... 66/200, 201, 172 E, 66/170, 171, 192, 178 A

[56] References Cited

UNITED STATES PATENTS

| | | | |
|---|---|---|---|
| 2,103,625 | 12/1937 | Longfin | 66/172 E |
| 2,347,005 | 4/1944 | Smith, Jr. | 66/201 |
| 3,063,271 | 11/1962 | Faust et al. | 66/82 |
| 3,248,905 | 5/1966 | Krauss et al. | 66/192 |
| 3,290,904 | 12/1966 | Snyder | 66/178 A |
| 3,301,017 | 1/1967 | Bird et al. | 66/178 A |
| 3,306,081 | 2/1967 | Miles et al. | 66/178 A |
| 3,477,257 | 11/1969 | Towslee, Jr. | 66/200 |

FOREIGN PATENTS OR APPLICATIONS

| | | | |
|---|---|---|---|
| 1,353,930 | 1/1964 | France | 66/178 A |
| 634,830 | 3/1950 | United Kingdom | 66/172 E |

OTHER PUBLICATIONS

Beebe, P. R., Shaping Up the 70's Knitwear Styles with Lycra–Elastomeric Yarn, In the Hosiery Trade Journal, pp. 100–103, Dec. 1973.

Spandex Technology, p. 99, Copyright 1964 by Monsanto Chemical Co.

Morehouse, J., How to Knit New Core–Spun Spandex Yarns, In Knitted Outerwear Times, pp. 50, 51, May 24, 1965.

*Primary Examiner*—Mervin Stein
*Assistant Examiner*—A. M. Falik

[57] ABSTRACT

An elastic double-knit fabric having alternating front and back wales knit from an elastic and inelastic yarn knit together in spaced patterns of adjacent stitches in adjacent front wales and in selected stitches in at least every fourth course in the back wales, all the remaining stitches in the fabric containing only inelastic yarn.

11 Claims, 3 Drawing Figures

DOUBLE-KNIT ELASTIC FABRIC WITH RAISED PATTERNS

BACKGROUND OF THE INVENTION

This invention relates to weft-knitted fabrics and more particularly to double-knit fabrics in which elastic yarn is present in a stretched condition in the face and back stitches of preselected areas of the fabric.

The elastic properties of spandex yarns enable manufacturers to produce a wide variety of fabrics ranging from foundation fabrics with outstanding holding power and figure control to outerwear, sportswear and underwear fabrics with excellent dimensional recovery providing ideal fit and comfort at all levels of body extension.

In making elastic, double-knit fabrics, it is customary for the elastic yarn to be knitted in the back stitches of the fabric to reduce "grin through" and to make economical use of the elastic yarn. In the present invention, in addition to the back stitches, the elastic yarn is also selectively incorporated into face stitches, or front wales of a double-knit fabric producing fabric relief patterns without departing from the basic double-knit construction.

This enables one to produce double-knit fabrics in which selected face stitches assume a more compact appearance or to produce fabrics with large areas of compact stitches in which the contraction of this area distorts the normal wale/course configuration to give curved courses maintaining relatively flat fabrics. In addition, double-knit fabrics can be produced in which certain areas are raised from the general fabric plane through the contracting action of the other areas.

The fabrics prepared by this invention are knit on either flat or circular machines with two needle beds capable of knitting with a double stitch giving double thickness to the fabric, hence the term double-knit. When referring to sweater construction the term rib-knit is used rather than the term double-knit. At least one of the beds has the capability of selectively knitting. At least two inelastic yarns are knit separately into a double-knit or rib-knit jacquard pattern. Spandex is knit with at least one of the inelastic yarns and at least one of the inelastic yarns is knit alone. The pattern is chosen so that the inelastic yarn being knit with the spandex is present in some face stitches and absent from others.

DEFINITIONS

By "inelastic" is meant a thread or yarn having a breaking elongation of less than 100%.

By "elastic" is meant a thread or yarn having a breaking elongation of at least 100% and an essentially complete and quick recovery from stretching to an elongation less than its breaking elongation.

A spandex yarn is a continuous filament, segmented polyurethane well known as an elastic fiber.

The term "yarn" or "thread" includes more than one end of a specified yarn type, either plied or unplied.

By "face stitches" is meant stitches in the front wales of a double-knit or rib-knit fabric.

SUMMARY OF THE INVENTION

An elastic double-knit fabric having courses knit with front and back wales, said courses comprising elastic and inelastic yarn knit together in spaced patterns of adjacent stitches of adjacent front wales and in selected stitches in at least every fourth course in each back wale, all the remaining stitches in both front and back wales being inelastic yarn.

DETAILED DESCRIPTION OF THE ILLUSTRATED EMBODIMENTS

Figure 1:
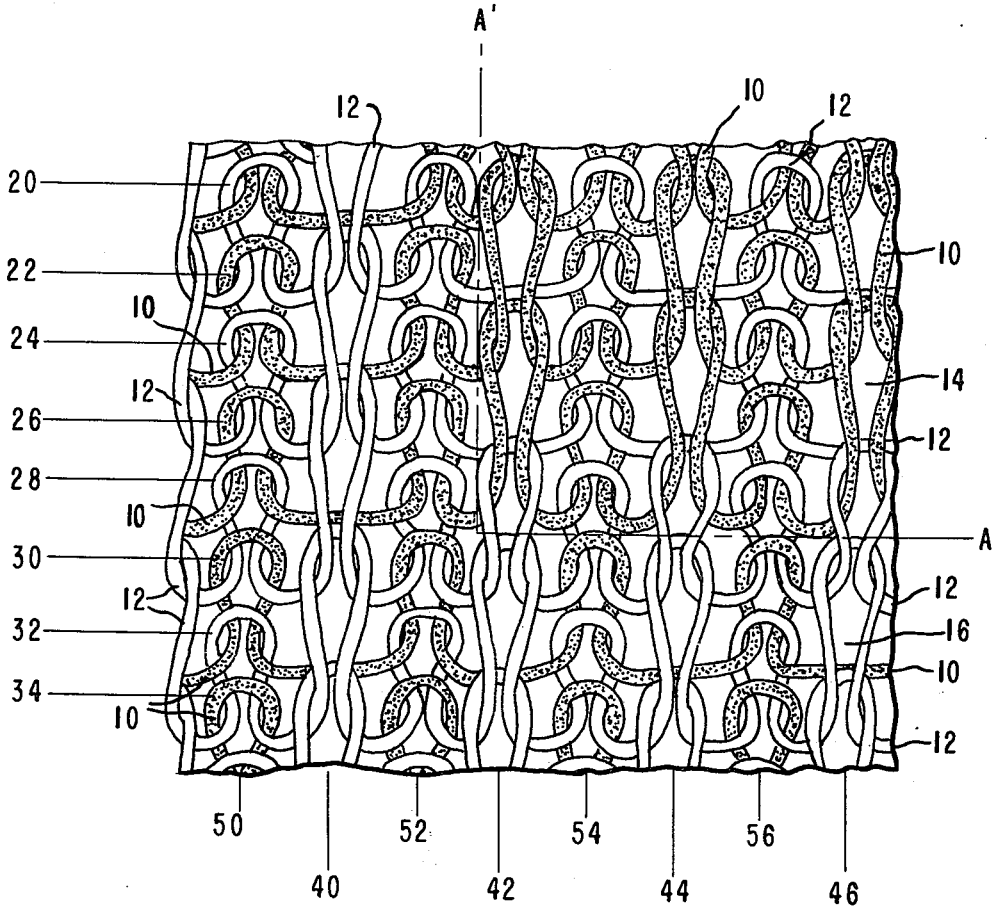
FIG. 1 is a fragmentary schematic illustration of a double-knit fabric of this invention in a stretched condition.

Referring to FIG. 1, the fabric embodiment chosen for purposes of illustration is seen to be a fabric having courses 20–34 (designated with even numbers only) with front wales 40, 42, 44, 46 and back wales 50, 52, 54, 56. The courses comprise a shaded component 10, which is a bare spandex yarn and an inelastic yarn as an associated pair knit together in grouped patterns of adjacent stitches (e.g., 42*a*, 42*b*, 44*a*, 44*b*, 46*a*, 46*b*) in parts of adjacent front wales (e.g., 42, 44, 46) and in alternate courses 22, 26, 30, 34 in the back wales. Unshaded component 12 is an inelastic yarn which is knit into all the remaining stitches. In the area of the fabric above and to the right of the line A—A′, one component comprising the combined spandex/inelastic yarn pair 10 appears in every stitch of each front wale; outside the specified area the spandex/inelastic yarn component 10 appears in no front wales. Throughout the whole fabric component 10 appears uniformly in alternate courses of each back wale. The other component inelastic yarn 12, appears uniformly in the remaining courses of each back wale and only in the front wales outside the specified areas.

Figure 2A:
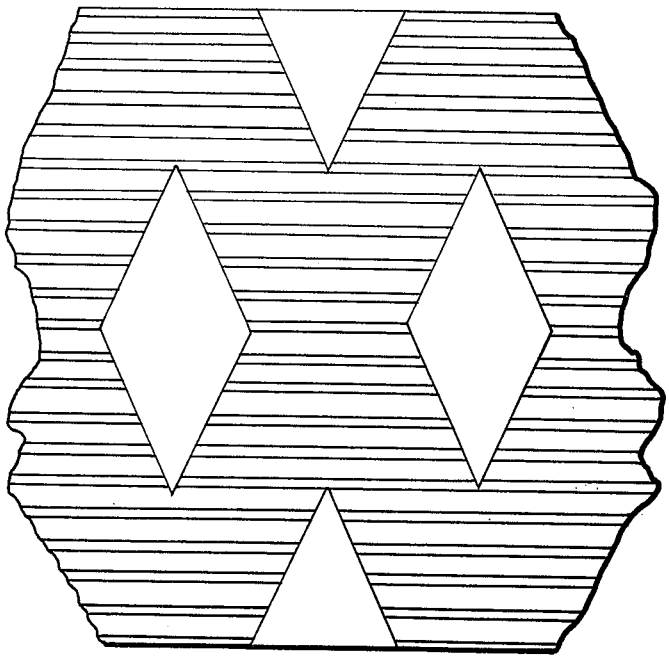
FIGS. 2A and 2B are schematic fragmentary illustrations of the fabric of this invention containing spaced diamond figures in the stretched and relaxed condition, respectively.
Figure 2B:
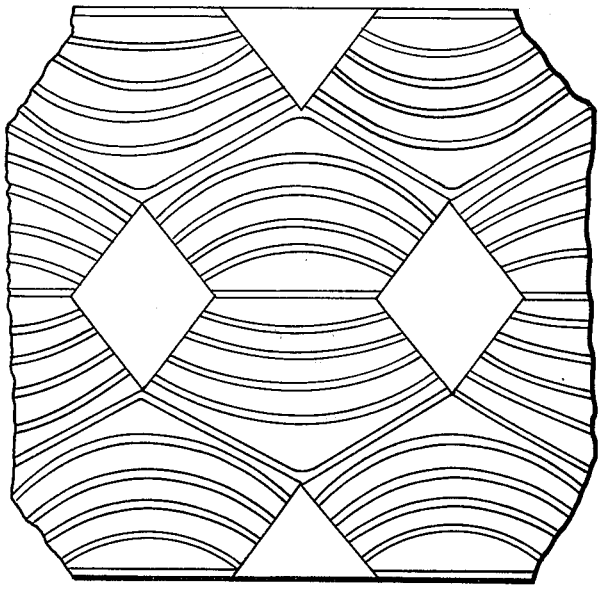

FIG. 2 contains the fragmemtary, diagrammatic views of the face of a different fabric embodiment. In FIG. 2A the fabric is in stretched condition as knit. In FIG. 2B the fabric is in relaxed condition following the treatment more fully described in Example 4.

Although FIG. 1 shows a simple 2-color jacquard construction with a horizontal stripe back, three- and four-color jacquard constructions may also be used as well as other back constructions.

In the practice of this invention, it is essential that the spandex be stretched before or during knitting in order to later provide the necessary compacting force. It is preferred to significantly stretch the spandex before knitting to provide a high retractive force. This may be accomplished by applying tension prior to knitting. Alternately, the spandex may be stretched by unrolling from the cake at a speed substantially slower than that at which the accompanying inelastic yarn is being drawn into the machine or by restricting its delivery by means of a positive feed tape system.

As the fabrics are allowed to relax on leaving the takeup system of the knitting machine, the contraction of those areas with spandex in the face stitches is substantially greater than the other areas, i.e., the loops 14 contract to a greater extent than the loops 16. This difference is further accentuated by additional relaxing of the fabric by steaming, washing, dry cleaning or tumbling.

Fabrics may be heat-set in the normal manner for fabric containing spandex. However, the fabrics must not be stretched to their full limit of extension during heating or the compacted stitches will be pulled out to their original knit dimensions and the stitch effects and elasticity will be lost.

Bare, abrasion-resistant spandex yarns are used in the fabrics of the present invention together with inelastic yarns. The type of inelastic yarns used will generally be governed by the desired characteristics of the type of fabric to be prepared. Synthetic and natural yarns, e.g., cotton, wool, rayon, nylon, acrylic fiber, polyester fiber, etc., may be used in staple, textured, or continuous filament form to produce a desired effect in the finished fabric. The amount of compression in the finished fabric may be readily controlled by those skilled in the art. The degree of stitch compaction may be varied by using different size or type spandex yarns, changing the spandex stretch during knitting or by using inelastic yarns of different weight or density.

Fabrics may be knitted with finished edges so that they may more easily be fabricated into garments.

It is not intended that the practice of this invention be confined to single yarns only. In cases where two or more yarns are used, the individual yarns need not necessarily be identical.

EXAMPLE 1

Using a circular 7-cut rib transfer machine, knitting one end per feed of 2/16 w.c. acrylic yarn, a standard 2-color welt jacquard construction with a striped back was prepared. By selectively knitting the cylinder needles, a checkerboard pattern was knit; the squares being six face wales wide and five face courses high. A 140-denier spandex yarn stretched to about 2.5 times its relaxed length was knit with one of the acrylic yarns.

The fabric was steamed unrestrained on a Hoffman press. The areas containing spandex in the face compacted to a greater degree than the other areas. This action raised the other areas above the general fabric plane. The resulting fabric weighed 16.5 oz./yd.$^2$ and had an average of 12 wales and 12 courses per inch. The areas containing spandex in the face stitches were 114 mils thick; the areas with spandex in the back only were 89 mils thick.

EXAMPLE 2

A vertically striped double knit fabric was prepared on an 18-cut circular knitting machine using blue and white 150-denier, textured polyester yarn. All dial needles were knit to produce a horizontally striped backing. Cylinder needles were knit selectively to produce a repeating vertical stripe pattern in white, four wales wide, and blue, eight wales wide. A 70-denier spandex yarn stretched about 2.5 times its relaxed length was knit with the white polyester yarn. When the fabric tension imposed by the take-down mechanism was relieved, the white area contracted to a greater degree than the blue area in a wale-wise direction, thus producing a puckered effect in the blue area. Unrestrained steaming further accentuated this puckering. The steam-relaxed fabric weighed 7.6 oz./yd.$^2$ and had 23 wales and 27 courses per inch. The white areas were 36 mils thick; the blue areas were 29 mils thick.

EXAMPLE 3

A vertically striped double knit fabric was prepared on an 18-cut circular knitting machine using blue and white 150-denier textured polyester yarn. Only alternate dial needles were knit at each feed to produce a bird's eye backing. Cylinder needles were knit selectively to produce a repeating vertical stripe pattern in white, four wales wide and blue, eight wales wide. A 70-denier spandex yarn stretched about 2.5 times its relaxed length was knit with the white polyester yarn. When the fabric tension imposed by the take-down mechanism was relieved, the blue areas appeared thicker than the white areas. This was accentuated by steam relaxing. The steam-relaxed fabric weighed 11.2 oz./yd.$^2$ and had 36 wales and 29 courses per inch. The white areas were 34 mils thick; the blue areas were 44 mils thick.

EXAMPLE 4

A fabric with a face pattern containing spaced diamond figures shown schematically in FIG. 2A was knit on a 7-cut circular knit rib transfer machine using a standard three-color jacquard construction with 2/16 w.c. acrylic yarn. All dial needles were knit to produce a horizontally striped back. Cylinder needles were selectively knit to produce the indicated pattern. The horizontal stripe face pattern was produced with two acrylic yarns; a third formed all face stitches in the diamond. A 140-denier spandex yarn stretched about two times its relaxed length was knit with the acrylic yarn which forms the diamond. After steaming unrestrained on a Hoffman press, the diamonds containing spandex in the face stitches contracted to a greater degree than the rest of the fabric. This contraction produced a flat fabric in which portions of some courses were dislocated from their original position in one direction along the wales while other portions of the same course were dislocated in the opposite direction. As shown in FIG. 2B, this dislocation forced many courses to take up an arched configuration rather than the usual straight-line configuration. This fabric weighed 18.6 oz./yd.$^2$. The diamond area was 111 mils thick and had 10 wales per inch and 11 courses per inch. The other areas were 107 mils thick and had 10 wales per inch and 8 to 9 courses per inch.

What is claimed is:

1. A fabric having courses knit with front and back wales, said courses comprising an elastic and an inelastic yarn knit together as a pair as one component and an inelastic yarn alone as the other component, said one component appearing in spaced groups of uninterrupted walewise series of stitches in adjacent front wales and in selected stitches in at least every fourth course in the back wales, all the remaining stitches in the fabric being the other component.

2. The fabric as defined in claim 1, said one component being knit in every third course in the back wales.

3. The fabric as defined in claim 1, said one component being knit in every other course in the back wales.

4. The fabric as defined in claim 1, said elastic yarn being spandex.

5. The fabric as defined in claim 1, being a double-knit fabric.

6. The fabric as defined in claim 1, being a rib-knit fabric.

7. The fabric as defined in claim 1, said grouped patterns being a diamond-shaped pattern.

8. An elastic double-knit fabric comprising: courses knit with front and back wales, said courses comprising an elastic and an inelastic yarn knit together as one component with an inelastic yarn alone as the other component, said fabric having a recurring pattern of groups of stitches in well-defined areas of the fabric, each front wale stitch within each said area being formed of the one component, each front wale stitch outside each said area being formed of the other component, the stitches in selected courses in the back wales being formed of the one component, all the remaining stitches in the back wales being formed of the other component.

9. The double-knit fabric as defined in claim 8, said elastic yarn being a continuous filament, spandex yarn.

10. The double-knit fabric as defined in claim 8, said one component being knit in alternate courses of each back wale.

11. The fabric as defined in claim 4, said spandex being bare spandex.

* * * * *